US005386868A

United States Patent [19]

Kingman et al.

[11] Patent Number: 5,386,868

[45] Date of Patent: Feb. 7, 1995

[54] APPARATUS AND METHOD OF COOLING REFRACTORY SAND BASED ON DEW POINT TEMPERATURE

[75] Inventors: Jack R. Kingman, Wampum; Gordon Perkins, Carlisle, both of Pa.

[73] Assignee: The Frog, Switch & Manufacturing Co., Carlisle, Pa.

[21] Appl. No.: 165,755

[22] Filed: Dec. 10, 1993

[51] Int. Cl.[6] ..... B22C 5/08; B22C 5/18

[52] U.S. Cl. ..... 164/456; 164/154.6

[58] Field of Search ..... 164/456, 157.4, 154.6, 164/155.6

[56] References Cited

U.S. PATENT DOCUMENTS

| | | | |
|---|---|---|---|
| 2,779,071 | 1/1957 | Herbruggen . | |
| 2,854,714 | 10/1958 | Dietert . | |
| 2,902,681 | 9/1959 | Dietert et al. | 164/456 X |
| 2,978,759 | 4/1961 | Hansberg . | |
| 3,172,175 | 3/1965 | Hartley . | |
| 3,472,307 | 10/1969 | Godding . | |
| 3,919,162 | 11/1975 | Austin . | |
| 3,947,420 | 3/1976 | Bardet . | |
| 3,958,623 | 5/1976 | Vissers et al. . | |
| 4,079,776 | 3/1978 | Niedermeyer . | |
| 4,121,646 | 10/1978 | Rikker . | |
| 4,141,404 | 2/1979 | McMullen . | |
| 4,150,704 | 4/1979 | Hoult . | |
| 4,252,001 | 2/1981 | Musschoot . | |
| 4,304,286 | 12/1981 | Waldron . | |
| 4,304,289 | 12/1981 | McMullen . | |
| 4,334,574 | 6/1982 | Rennie et al. . | |
| 4,437,834 | 3/1984 | Vogel . | |
| 4,475,350 | 10/1984 | Waldron . | |
| 4,550,768 | 11/1985 | McMullen et al. . | |
| 4,598,759 | 7/1986 | Allread et al. . | |
| 4,780,665 | 10/1988 | Mitchell . | |
| 4,915,160 | 4/1990 | Reynolds . | |
| 5,054,538 | 10/1991 | Ibsen . | |
| 5,069,267 | 12/1991 | Larsen . | |
| 5,125,448 | 6/1992 | Jensen . | |

FOREIGN PATENT DOCUMENTS

| | | | |
|---|---|---|---|
| 3915231 | 11/1990 | Germany . | |
| 56-117853 | 9/1981 | Japan | 164/456 |
| 56-146728 | 11/1981 | Japan | 164/456 |
| 57-50236 | 3/1982 | Japan . | |
| 59-87950 | 5/1984 | Japan . | |
| 59-127948 | 7/1984 | Japan | 164/154.6 |

*Primary Examiner*—J. Reed Batten, Jr.

*Attorney, Agent, or Firm*—Webb Ziesenheim Bruening Logsdon Orkin & Hanson

[57] ABSTRACT

Foundry molds are made principally from a mixture of refractory sand, a binder and a catalyst. The temperature of recycled sand is measured and a cooling medium is contacted with the sand. The flow of the cooling medium is controlled to cool the sand to a temperature within a predetermined temperature range which is slightly above a measured dew point temperature. Controlling the sand temperature to a temperature slightly above the dew point temperature prevents moisture condensation in the sand which interferes with binder curing to provide increased strength and controlled shelf life in the sand, binder and catalyst mixture.

19 Claims, 1 Drawing Sheet

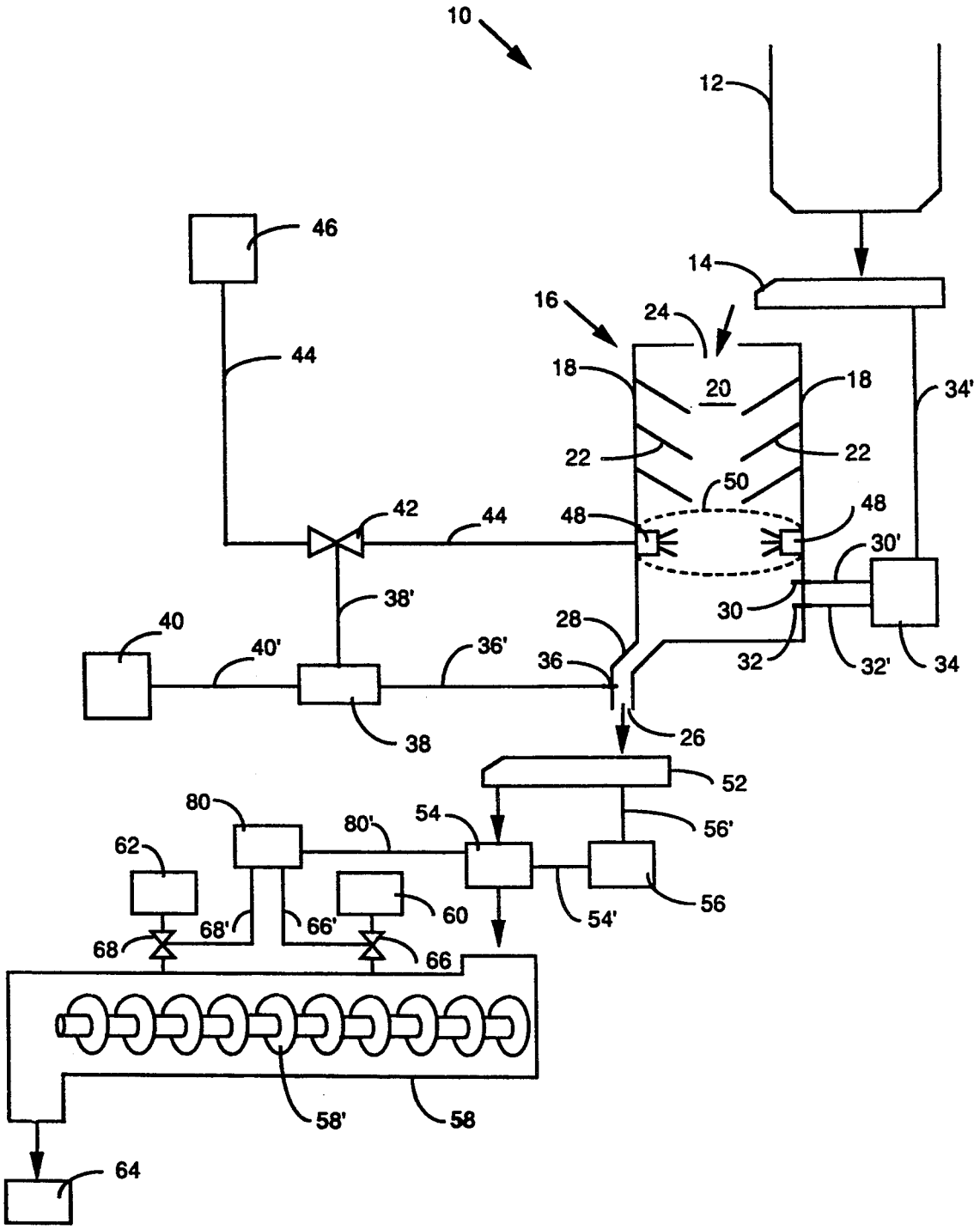
10
12
14
16
18
20
22
24
26
28
30
30'
32
32'
34
34'
36
36'
38
38'
40
40'
42
44
46
48
50
52
54
54'
56
56'
58
58'
60
62
64
66
66'
68
68'
80
80'

APPARATUS AND METHOD OF COOLING REFRACTORY SAND BASED ON DEW POINT TEMPERATURE

BACKGROUND OF THE INVENTION

1. Field of the Invention

This invention relates to an apparatus and method for cooling refractory sand used in the making of foundry molds and, more particularly, relates to cooling refractory sand used in no-bake molding.

2. Description of the Prior Art

Casting is one of the most common and economical metal forming techniques and involves the pouring of molten metal into a preformed cavity in a mold, wherein the metal then solidifies. The mold can be made from sand or other molding material. After solidification, a cast metal shape is removed from the mold by knocking away the outer molding material. This molding material is then reused to form new molds.

Refractory sand is the main component in making common foundry molds. The sand is constantly recycled from used, hot molds and returned to a storage bin. As a result of this constant recycling, the temperature of the sand in the storage bin is typically elevated above ambient temperature.

At present, there are two common methods of forming a sand based foundry mold. In a first method, called "green sand molding", a binding material composed of clay, water and other additives is mixed with the refractory sand to form a free flowing, homogeneous mixture. A mold cavity is formed by pouring this mixture over a pattern which is then removed to form the cavity.

In a second common method, called "no-bake molding", sand is supplied to a mixing device. A resin binder is then added to the sand. A catalyst is added to promote curing of the binder. This mixture is then poured over a mold forming pattern and allowed to harden prior to use.

The resin binder is very temperature sensitive. If sand is supplied to the mixing device at too high a temperature, the binder begins to cure in the mixing device, thereby prematurely hardening the mixture. Thus, by the time the mixture is supplied to a molding station, it has already bonded to such an extent that it is too stiff to be used in the mold.

To prevent this premature curing of the resin binder caused by elevated refractory sand temperatures, various sand cooling methods have been developed. In U.S. Pat. No. 4,304,286 to Waldron, a liquefied gas is injected into a conduit through which the sand is falling to reduce the sand temperature below the resin curing temperature. Other cooling methods include the use of fluidized beds and water sprinkling systems.

The main purpose of the prior art cooling methods is to control the refractory sand temperature primarily to prevent premature curing of the resin binder. The effect of the moisture content in the refractory sand on the binder has not heretofore been a consideration in the prior art.

Moisture sensitive binders have been developed for which temperature control alone is insufficient. Thus, the problem of moisture accumulation in the sand is also an important concern since accumulated moisture reacts with the moisture sensitive binder to affect premature binder curing.

Accordingly, it is an object of the instant invention to overcome the deficiencies in the prior art with respect to cooling refractory sand and to controlling moisture content thereof.

SUMMARY OF THE INVENTION

Foundry molds are formed by combining refractory sand, a binder and a catalyst to form a free flowing mixture. This mixture is poured over a mold forming pattern to harden.

To control the temperature of the sand, the apparatus of the present invention includes a chamber into which the refractory sand flows, as well as means for sensing the temperature of the sand as it exits the chamber. The apparatus further includes means for introducing a flow of cooling medium into the chamber to cool the sand to a temperature within a predetermined temperature range above a measured dew point temperature. Keeping the sand temperature above the dew point temperature prevents moisture condensation in the sand which could affect the curing of the binder.

The method of the present invention is practiced by carrying out the steps of determining a dew point temperature, supplying sand to the chamber, measuring a temperature of the sand exiting the chamber, introducing a flow of cooling medium into the chamber and controlling the flow of the cooling medium to maintain the sand temperature above the determined dew point temperature.

BRIEF DESCRIPTION OF THE DRAWING

The FIG. is a schematic drawing illustrating the preferred embodiment of the mold making apparatus.

DESCRIPTION OF THE PREFERRED EMBODIMENT

The drawing schematically represents a presently preferred embodiment of a mold making apparatus 10 made in accordance with the invention. The mold making apparatus 10 includes a refractory sand storage bin 12 positioned above and in fluid communication with a first vibrating conveyor 14. For example, the first conveyor 14 may be a Model F450 manufactured by FMC Corporation of Chicago, Ill. A cooling chamber 16 is positioned below and in fluid communication with the first conveyor 14. The conveyor 14 is adapted to vibrate the refractory sand to thereby break apart any lumps of sand which may have formed while the sand resided in the storage bin 12. This vibratory action insures that finely divided sand granules exit the first conveyor 14.

The chamber 16 is defined by a plurality of outer walls 18 defining an inner cavity 20. A plurality of downwardly staggered baffle plates 22, over which the sand falls, are secured to the chamber walls 18. An inlet 24 is disposed in an upper wall of the chamber 16. An outlet 26, disposed within a discharge chute 28, is formed in a lower wall of the chamber 16.

A high level sensor 30 and a low level sensor 32 are disposed within the chamber 16. These level sensors 30 and 32 can be, for example, contact sensors.

The level sensors 30 and 32 are in electronic communication by way of lead wires 30' and 32', respectively, with a level controller 34. The level controller 34 can be, for example, a Model CRSDC2B manufactured by FMC Corporation of Chicago, Ill., which is well-known in the field. The controller 34 is in further electronic communication by way of lead wire 34' with the first conveyor 14.

A temperature sensor 36, for example, a thermocouple, is disposed within the discharge chute 28 and is positioned to be in direct contact with sand falling through the chute 28. The temperature sensor 36 is in electronic communication by way of lead wire 36' with a temperature controller 38, for example, a Model D-U-07-0539 manufactured by Athena Controls Inc. of Plymouth Meeting, Pa.

A dew point sensor 40, for example, a Fisher Scientific brand hygrometer/thermometer, is located adjacent the apparatus 10, preferably positioned outside the chamber 16. The dew point sensor 40 may be in electronic communication by way of lead wire 40' with the temperature controller 38. Alternatively, the dew point sensor 40 measurement can be read by an operator and manually entered into the temperature controller 38. The temperature controller 38 is in electronic communication by lead wire 38' with a solenoid valve 42 located in a coolant supply pipe 44. The coolant supply pipe 44 is in fluid communication with a coolant storage container 46 and places the coolant storage container 46 in fluid communication with a plurality of coolant spray nozzles 48 disposed within the chamber 16. The spray nozzles 48 are mounted on an annular pipe 50 which is also in fluid communication with the coolant supply pipe 44.

A second vibrating conveyor 52, for example, a Syntron brand conveyor, is positioned below the discharge chute 28 of the chamber 16 to receive particulate material therefrom.

A mass flow meter 54, for example, a paddle-wheel type flow meter well-known in the industry, is positioned below the second conveyor 52 such that material discharged from the conveyor 52 falls by gravity and passes therethrough. The flow meter 54 is in electronic communication by way of lead wire 54' with a mass flow controller 56, for example, a Model FMD manufactured by Schenck Weighing Systems of Fairfield, N.J. This flow controller 56 is in further electronic communication by way of lead wire 56' with the second conveyor 52.

A binder/catalyst control 80, for example, a Model MICON 2000 manufactured by SCRATA of Sheffield, England, is in electronic communication by way of lead wires 80' with the mass flow meter 54. The binder/catalyst control 80 is also in electronic communication by way of lead wire 66' with a binder control valve 66 and in further electronic communication by way of lead wire 68' with a catalyst control valve 68.

A mixing device 58, for example, a rotating auger-type mixing device, is positioned below the flow meter 54 to receive material discharged therefrom. A binder holding tank 60 and a catalyst holding tank 62 are disposed in fluid communication with the mixing device 58. The amounts of binder and catalyst injected into the mixing device 58 are preferably controlled in a variable manner, for example, by valves 66 and 68. A mold 64 is positioned below the mixing device 58 to receive the mixture discharged therefrom.

Operation of mold making apparatus 10 is described as follows. Refractory sand is discharged from the storage bin 12 onto the first vibrating conveyor 14 for transfer into the cooling chamber 16. The vibratory motion of the first conveyor 14 helps to maintain the refractory sand as finely divided granules by breaking apart any lumps of sand which may have formed in the storage bin 12.

Under the influence of gravity, the sand falls over the baffle plates 22, through the chamber 16 and then accumulates at the bottom of the chamber 16. The baffle plates 22 function to disperse the sand granules, allowing the cooling medium to contact a greater surface area of sand. Thus, the sand is cooled uniformly, and the unwanted occurrence of localized hot spots is minimized.

The level sensors 30 and 32, disposed within the chamber 16, are in electronic communication with the level controller 34 which is in further electronic communication with the first vibrating conveyor 14. The level controller 34 controls the speed of the first conveyor 14 as a function of the level of sand in the chamber 16. For instance, if the sand level accumulates above the high level sensor 30, the level controller 34 decreases the speed of the first conveyor 14 to reduce sand input into the chamber 16. Conversely, when the sand level falls below the low level sensor 32, the controller 34 causes the speed of the first conveyor 14 to increase, thus, causing a greater quantity of sand to be delivered to the chamber 16.

Finely divided sand leaves the chamber 16 through the discharge chute 28 located near the bottom of the chamber 16. The temperature sensor 36, located in the discharge chute 28, supplies continuous sand temperature measurement directly to the temperature controller 38. The temperature controller 38, as previously described, may also be in electronic communication with the dew point sensor 40.

The current dew point temperature is measured by the dew point sensor 40 and is used as a base line control temperature by the temperature controller 38. As mentioned above, the dew point temperature may be automatically or manually entered into the temperature controller 38. The temperature controller 38 is programmed to maintain the temperature of the sand discharged from the chamber 16 to a temperature within a predetermined temperature range slightly above the current dew point temperature. For example, with a dew point of 77° F. (25° C.), the sand temperature is preferably controlled between 79° F. and 80° F. (26.1° C. and 26.7° C.).

If the temperature of the sand in the discharge chute 28 as measured by the temperature sensor 36 is above the base line control temperature, the temperature controller 38 throttles open the solenoid valve 42 located in the coolant supply piping 44 of the coolant storage container 46. This allows coolant, for example, liquefied atmospheric gases such as nitrogen or carbon dioxide, to flow from the storage container 46 into the chamber 16 through the coolant nozzles 48 located within the chamber 16. The coolant gas contacts the sand granules flowing through the chamber 16, thus, cooling the granules to a temperature within the predetermined temperature range. As the sand temperature in the discharge chute 28 approaches the control temperature, the temperature controller 38 throttles the solenoid valve 42 closed.

Sand discharged from the chamber 16 through the discharge chute 28 is then transported by the second vibratory conveyor 52 through the mass flow meter 54 disposed at an inlet to the mixing device 58 and into the mixing device 58. The output generated by the mass flow meter 54 is monitored by the mass flow controller 56 which, in turn, variably regulates the speed of the second vibratory conveyor 52 to control the amount of sand delivered to the mixing device 58.

A predetermined mass flow value is entered into the mass flow controller 56. If the real time mass flow sensed by the mass flow meter 54 is below this predetermined value, the mass flow controller 56 increases the speed of the second vibratory conveyor 52 to increase the amount of sand flowing into the mixing device 58. If the real time flow of sand into the mixing device 58 is greater than this predetermined mass flow value, the mass flow controller 56 decreases the speed of the second vibratory conveyor 52.

A predetermined value of volume by weight of both binder and catalyst as a function of the predetermined mass flow of sand is entered into the binder/catalyst control 80. When sand flow through the mass flow meter 54 is sensed, an input signal through lead wire 80' to the binder/catalyst control 80 causes the binder/catalyst control 80 to open the binder valve 66 and the catalyst valve 68 to inject predetermined amounts of binder and catalyst into the mixing device 58 from the binder holding tank 60 and the catalyst holding tank 62. For example, 2.25% of the sand weight of binder and 11% of the sand weight of catalyst are injected into the mixing device 58. The binder, catalyst and sand combination is then mixed by the rotating auger screw 58' which longitudinally extends within the mixing device 58. This blended mixture of sand, binder and catalyst is then discharged from the mixing device 58 and poured into the mold 64.

There are two primary areas of concern in forming the molds. The first of these concerns is the "bench life" of the mixture. Bench life is defined as the period of time between the introduction of the binder and catalyst into the sand and the time the mixture has hardened to such an extent that it can no longer be formed around the pattern. The bench life of the mixture must be controlled to ensure an adequate minimum length of time to make a mold, as well as a maximum length of time to allow timely further processing of the mold. Through testing and experimentation, we have found that a bench life between about 12 to 30 minutes gives satisfactory results for most molding requirements.

The second area of concern is the "tensile strength" of the sand, binder and catalyst mixture after it has cured. The tensile strength of the mixture must be controlled to ensure adequate strength to hold the mixture together when molten metal is poured into the hollow chamber but, at the same time, must not be so excessive that the mixture cannot be broken apart and returned to grain size for reuse. Through testing and experimentation, we have found that a tensile strength between about 75 psi and 130 psi gives satisfactory results for most molding requirements.

Both temperature and moisture content of the sand have direct influence on bench life and tensile strength of the mixture. Exposure to high temperatures reduces the bench life of the mixture but increases its resultant tensile strength. Exposure to moisture, as would be the situation when the temperature of the sand is allowed to drop below the atmospheric dew point, increases the bench life of the mixture but reduces its tensile strength. Hence, it is preferred that the cooled sand temperature be only slightly above the dew point temperature. Specifically, it is preferable that the temperature range be controlled within 1°–10° C., preferably within 1°–5° C., or more preferably 2°–3° C. above the dew point temperature.

As previously discussed, the sand temperature is generally substantially above the dew point temperature when it enters the chamber 16. However, in the infrequent circumstance where, for example, the sand is stored in a cold location, the temperature of the sand as it enters the chamber 16 may already be below the dew point temperature. Heating devices, such as electric heater elements (not shown), may be placed in the chamber 16 or storage bin 12 to heat the sand to a temperature within the predetermined range slightly above the dew point temperature.

Having described the presently preferred embodiment of the invention, it is to be understood that it may otherwise be embodied within the scope of the appended claims.

We claim:

1. An apparatus for making sand molds comprising:
means for determining a dew point temperature;
a chamber having an inlet and an outlet for, respectively, receiving and discharging sand therefrom;
means for sensing the temperature of sand discharged from said chamber;
means for introducing a flow of cooling medium into said chamber based on said sensed temperature to contact and reduce the temperature of said sand; and
means for controlling the flow of said cooling medium in response to said sensed sand temperature such that said sand is maintained within a predetermined temperature range above the dew point temperature to prevent moisture condensation in said sand.

2. The apparatus as claimed in claim 1 further comprising means for mixing sand discharged from said chamber.

3. The apparatus as claimed in claim 2 further comprising means for supplying a binder and a catalyst to said mixing means.

4. The apparatus as claimed in claim 3 further comprising means for supplying a free flowing mixture of sand, catalyst and binder from said mixing means to a means for forming molds.

5. The apparatus as claimed in claim 2 further comprising a conveyor disposed at an outlet of said chamber.

6. The apparatus as claimed in claim 5 further comprising:
means for sensing flow disposed between said conveyor and said mixing means; and
means for controlling the speed of said conveyor.

7. The apparatus as claimed in claim 5 wherein said conveyor is a vibratory conveyor.

8. The apparatus as claimed in claim 1 further comprising a conveyor for conveying sand into said chamber.

9. The apparatus as claimed in claim 8 further comprising:
means for sensing the level of sand in said chamber; and
means for controlling the speed of said first conveyor based upon said sensed sand level.

10. The apparatus as claimed in claim 8 wherein said conveyor is a vibratory conveyor.

11. An apparatus for making molds comprising:
means for determining a dew point temperature;
a chamber for receiving and discharging sand;
means for feeding sand through the chamber;
means for sensing the temperature of said sand discharged from said chamber;

means for introducing a flow of cooling medium into said chamber;

means for controlling the flow of said cooling medium in response to said sensed sand temperature such that said sand is maintained within a predetermined temperature range above said dew point temperature to prevent moisture condensation in said sand; and means for mixing said temperature controlled sand with predetermined amounts of a binder and a catalyst to produce a mold making mixture having a predetermined bench life and a controlled tensile strength.

12. A method for making molds comprising the steps of:

determining a dew point temperature;

supplying sand to a chamber;

measuring the temperature of said sand;

introducing a flow of cooling medium into said chamber to contact and reduce the temperature of said sand;

controlling the flow of said cooling medium into said chamber to maintain the temperature of the sand within a desired temperature range above said dew point temperature to provide a temperature controlled sand;

supplying said temperature controlled sand, a binder and a catalyst into a mixing device to produce a mold making mixture having a predetermined bench life and a controlled tensile strength; and supplying said mold making mixture to a mold.

13. The method for making molds as claimed in claim 12 wherein the flow of said cooling medium is controlled to maintain the temperature of the sand within a temperature range of 1°–10° C. above said dew point temperature.

14. The method for making molds as claimed in claim 12 wherein the flow of said cooling medium is controlled to maintain the temperature of the sand within a temperature range of 1°–5° C. above said dew point temperature.

15. The method for making molds as claimed in claim 12 wherein the flow of said cooling medium is controlled to maintain the temperature of the sand within a temperature range of 2°–3° C. above the dew point temperature.

16. The method for making molds as claimed in claim 12 wherein the temperature of said sand is measured as said sand exits said chamber.

17. The method set forth in claim 12 wherein the predetermined bench life of the mold making mixture is between about 12 to 30 minutes.

18. The method set forth in claim 12 wherein the tensile strength of the mold making mixture is controlled between about 75–130 psi.

19. An apparatus for making molds comprising:

means for determining a dew point temperature;

means for feeding sand through a chamber;

means for sensing the temperature of said sand discharged from said chamber;

means for introducing a flow of cooling medium into said chamber; and means for controlling the flow of said cooling medium in response to said sensed sand temperature such that said sand is maintained within a predetermined temperature range above said dew point temperature to prevent moisture condensation in said sand.

* * * * *